US009285183B2

(12) United States Patent
Rentz

(10) Patent No.: US 9,285,183 B2
(45) Date of Patent: Mar. 15, 2016

(54) BOW LOOP RETAINER

(71) Applicant: Gregory E. Summers, Madison Heights, VA (US)

(72) Inventor: Marc T. Rentz, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 14/478,059

(22) Filed: Sep. 5, 2014

(65) Prior Publication Data

US 2015/0068507 A1 Mar. 12, 2015

Related U.S. Application Data

(60) Provisional application No. 61/874,668, filed on Sep. 6, 2013.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | | |
|---|---|---|---|---|---|
| 3,948,243 | A * | 4/1976 | Gazzara, Sr. | F41B 5/1469 | 124/35.2 |
| 3,954,095 | A * | 5/1976 | Lewis | 124/35.2 | |
| 4,009,703 | A * | 3/1977 | Cunningham, Sr. | 124/35.2 | |
| 4,062,339 | A * | 12/1977 | Wilson | 124/35.2 | |
| 4,249,507 | A * | 2/1981 | Marra | 124/35.2 | |
| 5,078,116 | A * | 1/1992 | Peck | F41B 5/1469 | 124/35.2 |
| 5,103,796 | A * | 4/1992 | Peck | 124/35.2 | |
| 5,359,983 | A * | 11/1994 | Peck | F41B 5/1469 | 124/35.2 |
| 5,566,664 | A * | 10/1996 | Todd | F41B 5/1469 | 124/35.2 |
| 6,481,430 | B1 * | 11/2002 | Lightcap, Jr. | 124/35.2 | |

* cited by examiner

*Primary Examiner* — John Ricci
(74) *Attorney, Agent, or Firm* — Leading-Edge Law Group PLC

(57) ABSTRACT

An archery release includes a gate pivotally connected with the release and movable between open and closed positions. When in the open position, the gate receives a bowstring, and when in the closed position, the gate retains the release on the bowstring so that the archer does not need to hold on to the release at all times. The release may be operated when the gate is in either the open or closed positions.

6 Claims, 2 Drawing Sheets

BOW LOOP RETAINER

This application claims the benefit of provisional application No. 61/874,668 filed Sep. 6, 2013.

BACKGROUND OF THE INVENTION

The present invention relates generally to archery releases. An archery release is used by an archer to fire an arrow. The release may be grasped, worn, or otherwise held at the end of a user's arm using wrist straps, glove-like straps, or a user's hand. Hand held releases are used by an archer to hold and pull a bowstring to a drawn potion and then releasing the bowstring to fire an arrow. Such releases improve the archer's accuracy and performance. Some hold/release devices directly hold and release a bowstring, while other devices indirectly hold and release a bowstring via an intermediate piece of string with two ends connected to the hold/release devise so that the string or bowstring look can be looped around a bowstring and then the loop can be held and released.

The present invention relates to a gate on a release which connects the release to a bowstring or string loop so that the release is always in close proximity to the hunter. The gate keeps the release on attached to the bow string without the hunter worrying about bumping it which would allow the release to fall to the ground.

BRIEF DESCRIPTION OF THE PRIOR ART

Archery releases of the hand held type are well-known in the patented prior art as evidenced for example by the Summers et al U.S. Pat. No. 8,622,051. While such releases operate satisfactorily, they must be continually gripped by the archer and thus are in danger of being inadvertently dropped. For example, when hunting, the archer may sit in a tree, in a tree stand, or on the ground while waiting for a shot. If the release is inadvertently dropped, the archer must retrieve the release, and potentially miss a clean shot because the release is not in the hunter's possession when a target is passing within range.

The present invention was developed in order to overcome these and other drawbacks of conventional hand held archery releases by providing a movable gate mechanism on the release to connect the release to a bowstring, even when the release is not in use.

SUMMARY OF THE INVENTION

Accordingly, it is a primary object of the invention to provide an archery release including a handle and a gate pivotally connected with the handle for movement between open and closed positions for receiving and retaining a bowstring. The gate contains a recess in which a spring and ball are arranged for pressing the ball into one of at least two detents arranged in an outer surface of the handle to retain the gate in either the open or closed position.

According to a more specific object of the invention, the gate includes a projection at one end and the handle includes a bail pivotally connected with the handle and operable to release the bow string when the gate is in either of the open or closed positions. The gate projection is adjacent the bail when the gate is in the closed position and spaced from the bail when the gate is in the open position.

It is a further object of the invention to provide the gate with an outer surface having a configuration which conforms to the outer surface of the handle so that the outer surface of the gate slides against the handle outer surface during movement of the gate.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
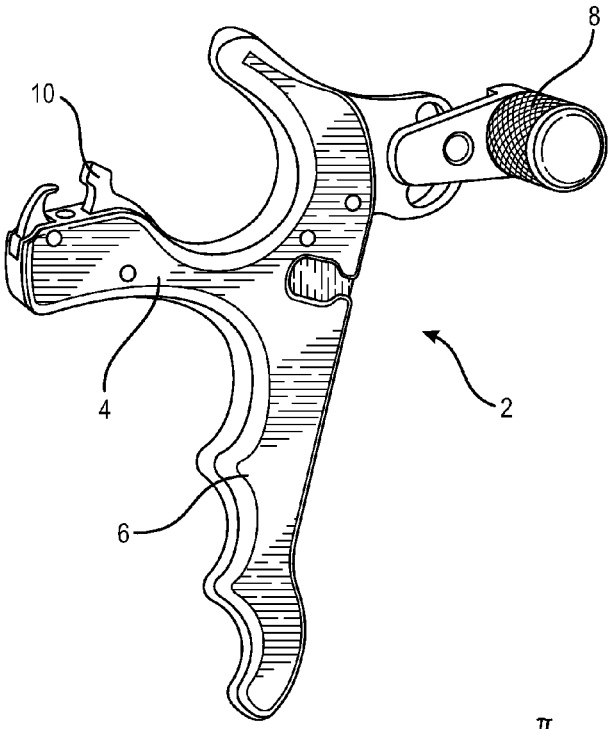
FIG. 1 is a front perspective view of a hand held archery release including a gate according to a preferred embodiment of the invention.
Figure 2:
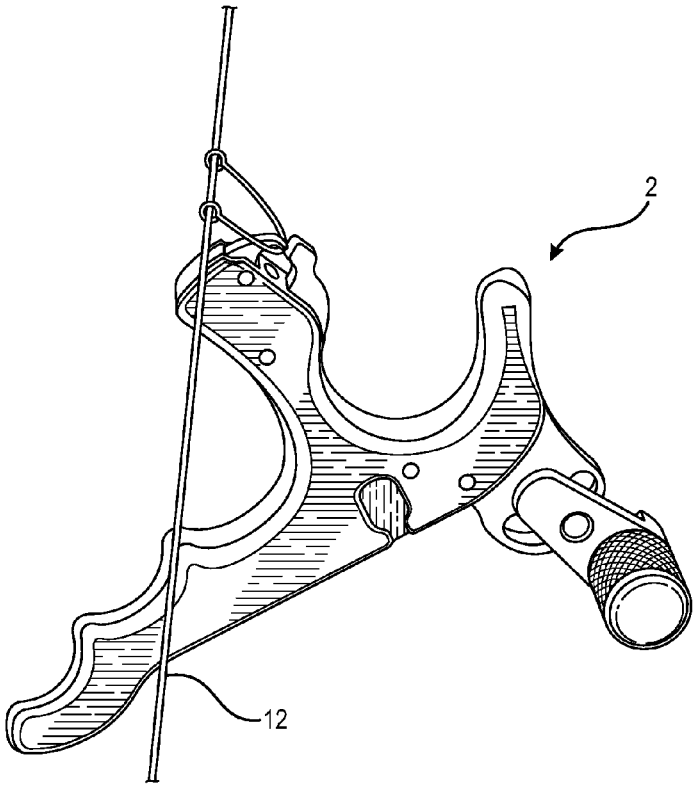
FIG. 2 is a perspective view of the archery release of FIG. 1 with a bowstring being retained by the gate of the release.

Referring first to FIGS. 1 and 2, a hand held archery release 2 according to the invention is shown. The release includes a handle 4 having a finger portion 6 and a thumb barrel adjustment knob 8 which provides a variety of thumb barrel positions. A gate 10 is connected with the handle and movable between open and closed positions. The gate can be used to connect or clamp a bowstring 12 as shown in FIG. 2 so that the release can be suspended from the bowstring when it is not being held by the archer.

Figure 3:
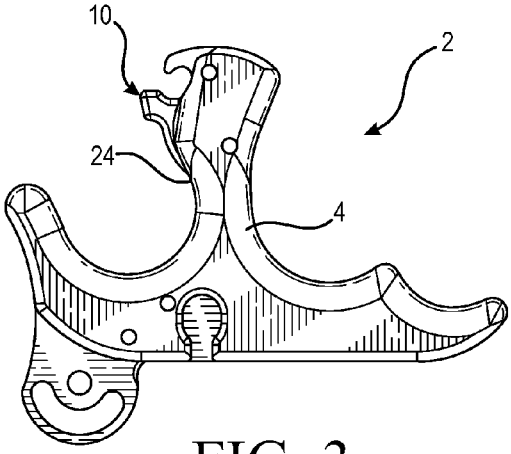
FIGS. 3 and 4 are partial rear plan views of the release of FIG. 1 showing the gate in the open and closed positions, respectively.
Figure 4:
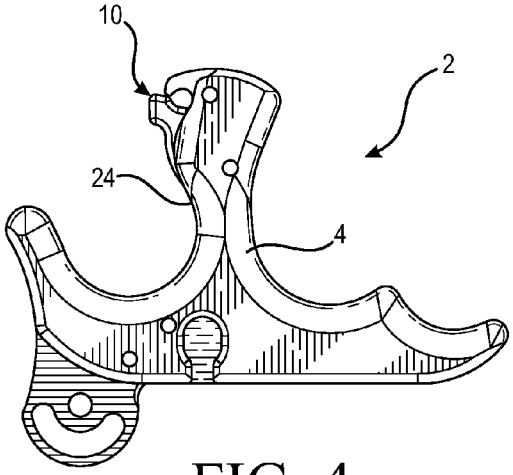
Figure 5:
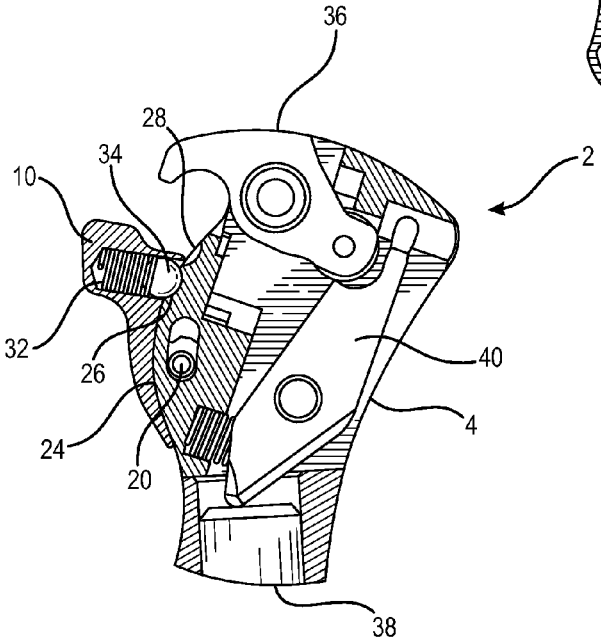
FIG. 5 is a partial sectional view of the archery release and gate according to the invention.
Figure 6:
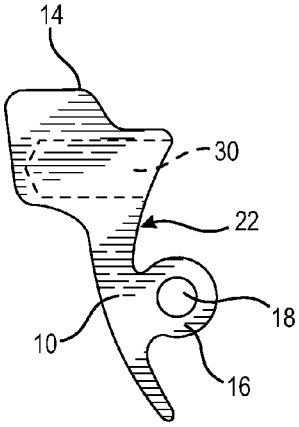
FIG. 6 is a plan view of the gate.

As shown in FIGS. 3-6, the gate 10 is pivotally connected with the handle 4 of the release. At one end, the gate includes a projection 14. At the other end, the gate includes a fitting 16 containing an opening 18. The fitting is arranged within a slot of the handle and a pivot pin 20 on the handle passes through the opening 18 in the fitting as shown in FIG. 5. Thus, the gate pivots about the pivot pin 20 for movement between open and closed positions which are shown in FIGS. 3 and 4, respectively.

The outer surface 22 of the gate 10 is configured to correspond with the outer surface 24 of the handle 4 so that the gate slides relative to the handle during movement between the closed and open positions. In the embodiment shown in the drawing, the gate outer surface is convex and the handle outer surface is concave, with the radius of curvature of both surfaces being generally the same.

The handle outer surface 24 contains at least two spaced recesses or detents 26 and 28 as shown in FIG. 5. The gate contains a recess or channel 30 within which a spring 32 and ball 34 are arranged. The ball 34 and detents 26, 28 serve to retain the gate in either the open or closed position. More particularly, when the gate 10 is in the open position as shown in FIG. 3, the ball 32 is arranged in the detent 26. In order to close the gate, the archer pushes upwardly on the gate, typically with the thumb or finger to displace the ball 34 inwardly into the channel 30 against the force of the spring 32. When the ball leaves the detent 26, the gate slides along the outer surface of the handle until the ball reaches and enters the detent 28 owing to the force on the spring. The ball detent mechanism retains the gate in the closed position shown in FIG. 4. In order to open the gate, the archer pushes downwardly on the gate to release the ball 34 from the detent 28 and the gate slides along the handle surface until the ball enters the detent 26.

In the closed position, the gate is arranged adjacent to a bail 36 of the release 2. As is known in the release art, a trigger (not shown) on the release is operable by the archer to displace a firing pin 38 to operate a sear 40 which in turn activates the bail to release a bowstring held by the bail.

The gate does not interfere with operation of the bail or the release. Thus, the release may be operated with the gate in either of the open or closed positions. When open, a bowstring may be arranged adjacent to the handle without being engaged by the bail. When the gate is closed, it retains the release on the bowstring as shown in FIG. 2. This allows the archer to let go of the release for hands free hunting or when the archer is waiting for a target to appear. The release is never far from the archer, however, so that the archer may remain in a ready position if a chance to shoot occurs.

No tools are required either to fasten the gate/release combination to a bowstring or to operate the gate between the closed and open positions.

While the preferred forms and embodiments of the invention have been illustrated and described, it will be apparent to those of ordinary skill in the art that various changes and modifications may be made without deviating from the inventive concepts set forth above.

What is claimed is:

1. An archery release, comprising (a) a handle including an outer surface containing at least two spaced detents; and (b) a gate connected with said handle for movement between open and closed positions for receiving and retaining a bowstring, said gate including a recess and a ball arranged in said recess and cooperating with said detents to retain said gate in one of said open and closed positions.

2. An archery release as defined in claim 1, wherein said recess further contains a spring which urges said ball toward said handle surface and into a selected detent.

3. An archery release as defined in claim 2, wherein said gate contains an outer surface having a configuration which conforms to said handle outer surface, said gate outer surface sliding relative to said handle outer surface during movement of said gate.

4. An archery release, comprising (a) a handle;

(b) a gate connected with said handle for movement between open and closed positions for receiving and retaining a bowstring, said gate including a projection at one end; and (c) a bail pivotally connected with said handle and operable to release the bowstring when said gate is in either of the open and closed positions, said projection of said gate being arranged adjacent said bail when said gate is in the closed position and spaced from said bail when said gate is in the open position.

5. An archery release as defined in claim 4, and further comprising a sear connected with said handle for operating said bail to release the bow string.

6. An archery release as defined in claim 5, wherein said handle contains a chamber and further comprising a firing pin arranged in a chamber for activating said sear.

* * * * *